US011647821B2

(12) United States Patent
Freeman et al.

(10) Patent No.: US 11,647,821 B2
(45) Date of Patent: May 16, 2023

(54) LOCKING CLIP FOR HAIR

(71) Applicant: Durham Enterprises Corporation, Salt Lake City, UT (US)

(72) Inventors: Michael Brian Freeman, North Salt Lake, UT (US); Benjamin Durham, South Jordan, UT (US)

(73) Assignee: Durham Enterprises Corporation, Salt Lake City, UT (US)

( * ) Notice: Subject to any disclaimer, the term of this patent is extended or adjusted under 35 U.S.C. 154(b) by 208 days.

(21) Appl. No.: 16/937,176

(22) Filed: Jul. 23, 2020

(65) Prior Publication Data

US 2021/0022469 A1 Jan. 28, 2021

Related U.S. Application Data

(60) Provisional application No. 62/877,733, filed on Jul. 23, 2019.

(51) Int. Cl.
*A45D 8/20* (2006.01)

(52) U.S. Cl.
CPC ..... *A45D 8/20* (2013.01)

(58) Field of Classification Search
CPC ... A45D 8/22; A45D 8/24; A45D 8/32; A45D 8/20; A45D 8/30; A45D 8/28; Y10T 24/4447; Y10T 24/44436; Y10T 24/44325
USPC ..... 132/309
See application file for complete search history.

(56) References Cited

U.S. PATENT DOCUMENTS

| | | | | |
|---|---|---|---|---|
| 7,493,903 | B2 * | 2/2009 | Rogers | A45D 8/22 132/277 |
| 7,950,401 | B2 | 5/2011 | Rogers et al. | |
| 7,992,579 | B2 | 8/2011 | Longoria et al. | |
| 2004/0177861 | A1 * | 9/2004 | Rogers | A45D 8/22 132/277 |
| 2004/0226574 | A1 | 11/2004 | Winn et al. | |
| 2009/0113679 | A1 * | 5/2009 | Malcomb | A61G 17/041 27/2 |
| 2020/0288837 | A1 * | 9/2020 | Tu | A45D 8/22 |

* cited by examiner

*Primary Examiner* — Nicholas D Lucchesi
*Assistant Examiner* — Jennifer Gill
(74) *Attorney, Agent, or Firm* — Dentons Durham Jones Pinegar

(57) ABSTRACT

A claw type or octopus type hair clip includes a first side, a second side, a hinge pin that pivotally couples the first side to the second side, and a lock that prevents the first side and the second side from undesirably pivoting to an open arrangement. The hair clip may include features, such as tabs that may be pressed together, that release the lock to enable the hair clip to be opened and placed over an object, such as an individual's hair. When lock-releasing features are released, the lock engages, enabling the first side and second side of the hair clip to be pivotally closed while preventing the first side and second side from pivotally opening.

14 Claims, 3 Drawing Sheets

LOCKING CLIP FOR HAIR

CROSS-REFERENCE TO RELATED APPLICATION

A claim for priority is hereby made pursuant to 35 U.S.C. § 119(e) to the Jul. 23, 2019 filing date of U.S. Provisional Patent Application No. 62/877,733, titled LOCKING CLIP FOR HAIR ("the '733 Provisional Application"). The entire disclosure of the '733 Provisional Application is hereby incorporated herein.

TECHNICAL FIELD

This disclosure relates generally to clips and, more specifically, to claw type clips. Even more specifically, this disclosure relates to clips that may be used in an individual's hair. A clip according to this disclosure may include a locking feature that prevents two sides of the clip from opening further. A clip according to this disclosure may including a ratcheting mechanism that enables the two sides of the clip to be pushed together even when the locking feature is locked.

RELATED ART

Claw type hair clips typically include two sides with claws that engage hair. A hinge couples the two sides and enables the two sides to pivot between a closed arrangement and an open arrangement. A spring forces the two sides into the closed arrangement. Handles on the two sides, adjacent to the hinge, can be grasped and squeezed together between a thumb and finger of an individual's hand to overcome the force of the spring to move the two sides into their open arrangement.

In use, an individual grasps and squeezes the handles together to open the two sides of a claw type hair clip, positions the claws of the open clip over her hair, and releases the handles to enable the spring to force the two sides of the clip together and the claws of the two sides of the clip to engage the hair. Although the springs of claw type hair clips typically hold the two sides securely in the closed arrangement, movement of an individual's head and/or hair sometimes overcomes the force of the spring, undesirably allowing the clip to open and to be moved out of place.

SUMMARY

A hair clip according to this disclosure, which may be referred to as a "clip" for the sake of simplicity, may include a first side and a second side that pivot relative to one another. The first side and the second side of the clip may pivot between an open arrangement and a closed arrangement. When in the closed arrangement, claws of the first side may be interleaved, or mesh, with claws of the second side; thus, the claws may grasp or otherwise engage hair while the clip is in the closed arrangement. When in the open arrangement, the claws of the first side and the claws of the second side may be moved away from each other, with a gap being formed between ends of the claws of the first side and ends of the claws of the second side.

A lock may at least partially secure, or lock, the first side and the second side into position relative to one another. As an example, the first side and the second side of the clip may be prevented from opening (or re-opening) beyond a certain point. Although a lock may limit the extent to which the first side and the second side of the clip may open, the clip may be capable of closing further. In some embodiments where the first side and the second side of the clip may be closed relative to each other, they may be prevented from opening any further. A clip that locks in any of the foregoing ways may include a release that enables an individual to selectively unlock the clip, enabling the first and second sides to pivot to a more open position.

Such a clip may include a spring that forces the first side and the second side apart from one another. Thus, when the lock is disengaged, the first side of the clip and the second side of the clip are forced into their open arrangement. The force of the spring may be overcome as the first side and the second side of the clip are forced together (e.g., manually, with an individual's hand; etc.).

As the first side and the second side are forced together, the lock may automatically engage in a manner that prevents the first side and the second side from re-opening relative to one another, securing, or locking, the first side and the second side into place relative to each other. Such locking may be continuous or intermittent (e.g., by way of or in a manner similar to a ratcheting mechanism, etc.).

When re-opening of the clip is desired, for example, to remove the clip from an individual's hair, the lock may be released and the first side and second side of the clip may be placed in their open arrangement. In embodiments where the spring forces the first side and the second side of the clip into their open arrangement, releasing the lock may enable the spring to force the first side and second side of the clip into their open arrangement, which may facilitate removal of the clip from hair or another object or group of objects.

Other aspects of the disclosed subject matter, as well as features and advantages of various aspects of the disclosed subject matter, should become apparent to those of ordinary skill in the art through consideration of the ensuing description, the accompanying drawings, and the appended claims.

DETAILED DESCRIPTION

FIGS. 1-11 illustrate an embodiment of a hair clip 10, which may also be referred to as a "clip 10" for the sake of simplicity. As illustrated, the clip 10 may have the configuration of a so-called "octopus" clip. Alternatively, a clip according to this disclosure may be configured as a more conventional "claw" clip.

Figure 9:
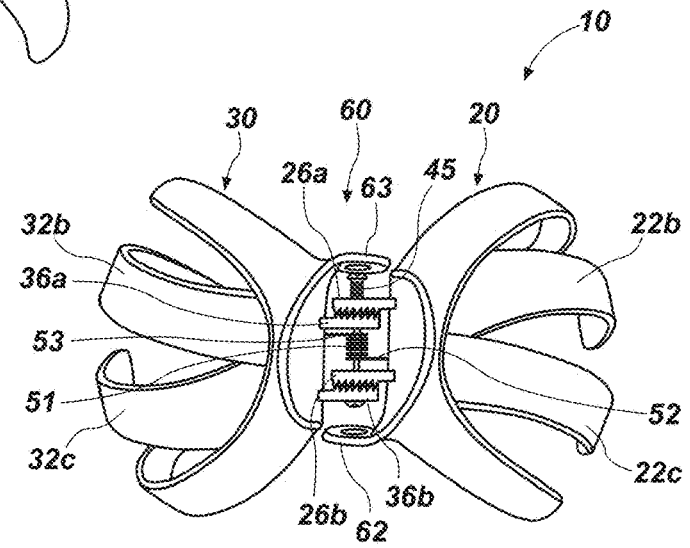
FIG. 9 is a top view of the clip in the open arrangement illustrated by FIG. 8.
Figure 10:
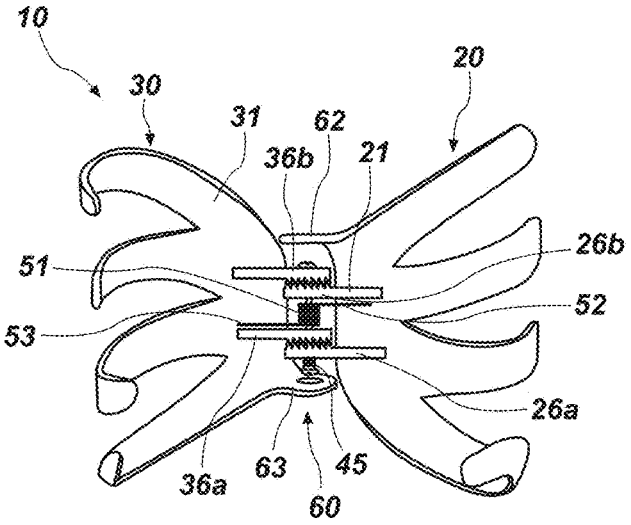
FIG. 10 is a side view of the clip in the open arrangement illustrated by FIG. 8.
Figure 11:
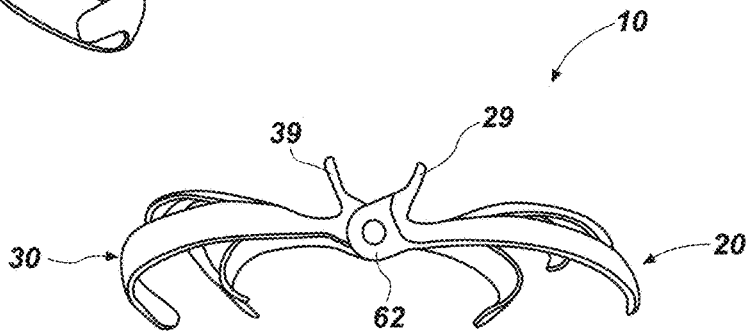
FIG. 11 is a bottom view of the clip in the open arrangement illustrated by FIG. 8.

The clip 10 includes a first side 20 and a second side 30 that are pivotally coupled to one another. The first side 20 and the second side 30 may be pivotally coupled to one another by way of a hinge pin 40; i.e., they may pivot over the hinge pin 40. FIGS. 1-8 show the first side 20 and the second side 30 in a closed arrangement. FIGS. 9-11 show the first side 20 and the second side 30 in an open arrangement. Any number of intermediate (i.e., partially opened, partially closed) arrangements are also possible. The clip 10 may also include one or more springs 50 associated with the first side 20, the second side 30, and the hinge 40. In addition, the clip 10 includes a lock 60 that prevents the clip 10 from unintentionally opening; i.e., the lock 60 may prevent the first side 20 and the second side 30 from undesirably moving apart from each other. Such a clip 10 may be used in an individual's hair, for example, in an up-do. The ability of such a clip 10 to lock may secure the clip 10 in an individual's hair until removal of the clip 10 is desired. Selectively releasing the lock 60 may enable the individual to remove the clip 10 from his or her hair or from another individual's hair.

Figure 1:
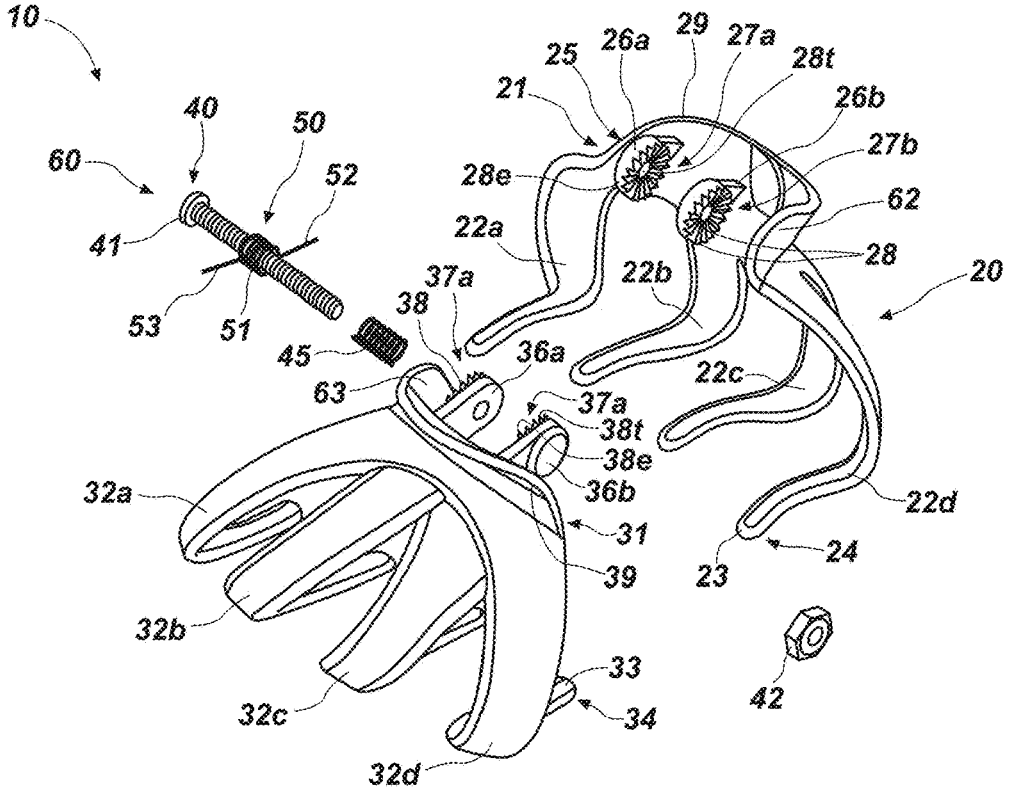
FIG. 1 is a perspective assembly view of an embodiment of a clip according to this disclosure, with a first side and a second side of the clip in a closed arrangement relative to one another.
Figure 2:
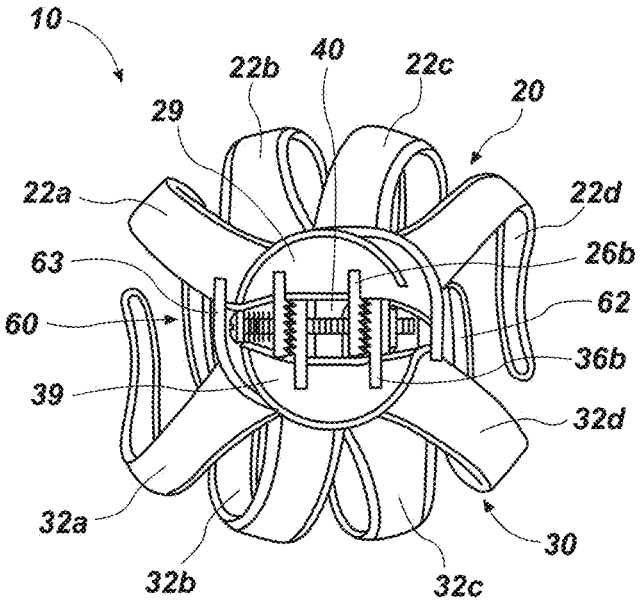
FIG. 2 is a top view of the clip shown in FIG. 1.
Figure 3:
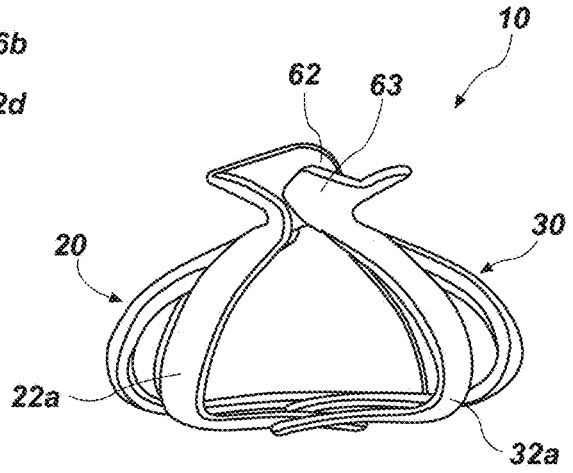
FIG. 3 is a side view of the clip shown in FIG. 1.
Figure 4:
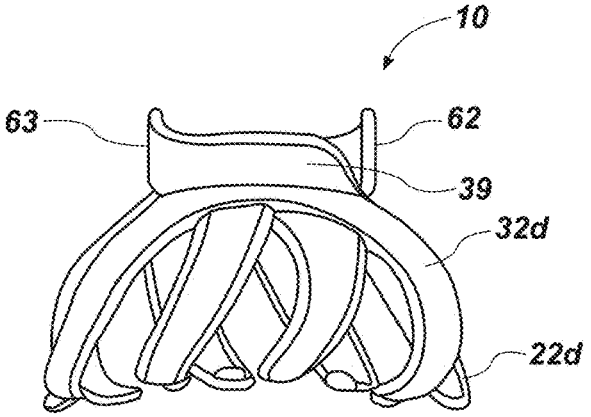
FIG. 4 is a front view of the clip shown in FIG. 1.
Figure 5:
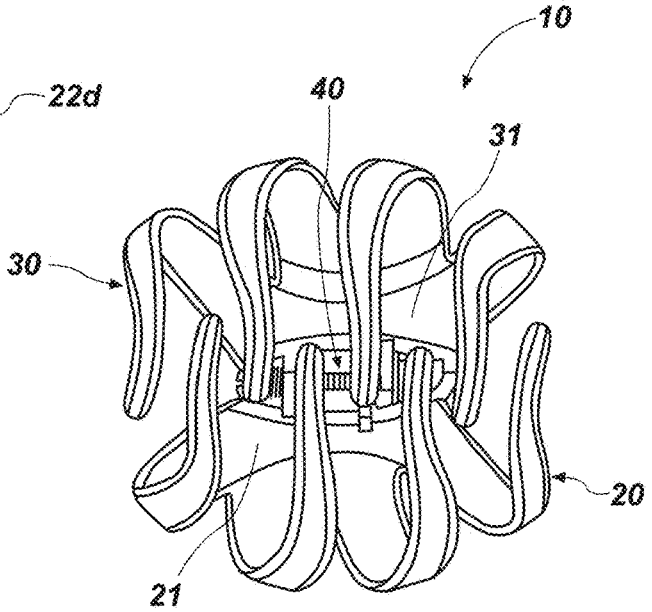
FIG. 5 is a bottom view of the clip shown in FIG. 1.
Figure 6:
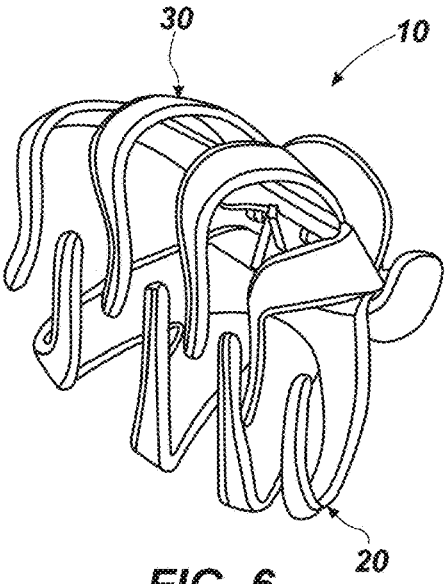
FIG. 6 is a perspective view of a bottom of the clip shown in FIG. 1.
Figure 7:
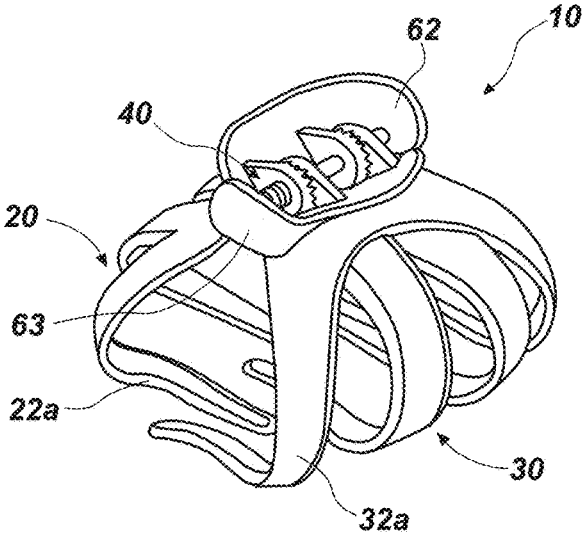
FIG. 7 is a perspective view of a top of the clip shown in FIG. 1.
Figure 8:
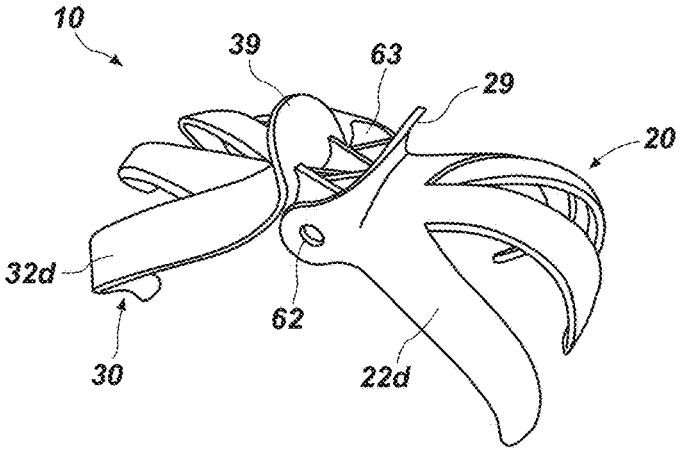
FIG. 8 is a perspective view of the clip of FIG. 1 with the first side and the second side of the clip in an open arrangement.

As illustrated by FIG. 1, the first side 20 of the clip 10 includes a top portion 21 from which a plurality of tines 22*a*, 22*b*, 22*c*, 22*d* (collectively, tines 22), or claws, extend in divergent directions. The tines 22 are spaced apart from one another, curve outwardly and downwardly from the top portion 21, and then curve downwardly and inwardly. Ends 23 of the tines 22 define a bottom 24 of the first side 20 of the clip 10.

The second side 30 of the clip 10 includes a top portion 31 from which a plurality of tines 32*a*, 32*b*, 32*c*, 32*d* (collectively, tines 32), or claws, extend in divergent directions. The tines 32 are spaced apart from one another, curve outwardly and downwardly from the top portion 31, and then curve downwardly and inwardly. Ends 33 of the tines 32 define a bottom 34 of the second side 30 of the clip 10.

The tines 22 may define a first grasping portion on a first side 20 of the clip 10, while the tines 32 may define a second grasping portion on a second side 30 of the clip 10. In embodiments where the clip 10 has a configuration that enables it to be used to hold an individual's hair (and in other uses of the clip 10), at least portions of the tines 22 and at least portions of the tines 32 may be interleaved with each other when the first side 20 and the second side 20 of the clip 10 are forced together. The shapes of the tines 22 and 32 may at least partially impart the clip 10 with a particular configuration, such as a claw configuration or an octopus configuration.

The first side 20 may also include a first hinge portion 25, which may protrude inwardly from the top portion 21 of the first side 20. The second side 30 may include a second hinge portion 35, which may protrude inwardly from the top portion 31 of the second side 30. The first hinge portion 25 may include two or more hinge members 26*a* and 26*b* that are spaced apart from each other. The second hinge portion 35 may likewise include two or more hinge members 36*a* and 36*b* that are spaced apart from each other. The spacing between the hinge members 26*a* and 26*b* of the first hinge portion 25 may be the same as the spacing between the hinge members 36*a* and 36*b* of the second hinge portion 35.

At least one hinge member 26*a*, 26*b* of the first hinge portion 25 may include a first engagement feature 27*a*, 27*b*. At least one hinge member 36*a*, 36*b* of the second hinge portion 35 may include a second engagement feature 37*a*, 37*b*. The first engagement feature(s) 27*a*, 27*b* and the second engagement feature(s) 37*a*, 37*b*, which may be complementary to each other, may be on opposed surfaces of corresponding hinge members 26*a* and 36*a*, 26*b* and 36*b* of the first hinge portion 25 and the second hinge portion 35, respectively. Such an arrangement may enable the first engagement features 27*a*, 27*b* to engage their corresponding second engagement features 37*a*, 37*b*.

Each complementary pair of engagement features, which includes a first engagement feature 27*a*, 27*b* and a second engagement feature 37*a*, 37*b*, may have a configuration that prevents the first side 20 and the second side 30 of the clip 10 from being opened, or pivoting, relative to one another beyond a certain extent, or point. In some embodiments, each complementary pair of engagement features 27*a* and 37*a*, 27*b* and 37*b* may enable the first side 20 and the second side 30 to close further, while preventing the first side 20 and the second side 30 from re-opening relative to each other. In a specific embodiment, each of first engagement feature 27*a*, 27*b* may comprise a series of teeth 28 arranged in a circle, with each tooth 28 including a side edge 28*s* and a tapered top 28*t*. Each second engagement feature 37*a*, 37*b* may likewise include a series of teeth 38 arranged in a circle, with each tooth 38 also including a side edge 38*s* and a tapered top 38*t*, but arranged in the opposite direction as the side edge 28*s* and tapered top 28*t* of each tooth 28 to enable adjacent teeth 28 and 38 to engage one another.

The side edge 28*s* of each tooth 28 may, when the tooth 28 is engaged between teeth 38 of the second engagement feature 37*a*, 37*b*, prevent movement of its corresponding hinge member 26*a*, 26*b* of its corresponding hinge portion 25 in a first direction (e.g., counterclockwise, when viewed from the side of the hinge member 26*a*, 26*b* that carries the teeth 28), in which the first side 20 and the second side 30 would otherwise pivot away from each other, or open. The tapered top 28*t* of each tooth 28 may, when the tooth 28 is engaged between teeth 38 of the second engagement feature 37*a*, 37*b*, enable movement of its corresponding hinge member 26*a*, 26*b* of its corresponding hinge portion 25 in a second direction, opposite from the first direction (e.g., clockwise, when viewed from the side of the hinge member 26*a*, 26*b* that carries the teeth 28), enable the first side 20 and the second side 30 of the clip 10 to pivot towards one another, or close.

The hinge pin 40 may extend through an aperture of each hinge member 26*a*, 26*b* of the first hinge portion 25 of the first side 20 of the clip 10 while engaging at least one hinge member 36*a*, 36*b* of the second hinge portion 35 of the second side 30 of the clip 10 (e.g., hinge member 36*b* in the embodiment illustrated by FIG. 1, etc.). Thus, the hinge pin 40 may be moved longitudinally in such a way that each hinge member 26*a*, 26*b* of the first hinge portion 25 may remain in place or substantially in place while at least one hinge member 36*a*, 36*b* of the second hinge portion 35 is carried with the hinge pin 40. Thus, each hinge member 36*a*, 36*b* of the second hinge portion 35 may be moved away from its corresponding hinge member 26*a*, 26*b* of the first hinge portion 25, enabling the second engagement feature 37*a*, 37*b* to disengage the first engagement feature 27*a*, 27*b*, and thus, unlocking the pivotal positions of the first side 20 and the second side 30 of the clip 10.

In a specific embodiment, the hinge pin 40 may include a head 41 at one end and include a fastener 42 at the other end. The fastener 42 may comprise a helical thread that engages a hinge member (e.g., hinge member 36*b* in the embodiment illustrated by FIG. 1, etc.), a bolt that engages threads on the hinge pin 40, an aperture and a cotter pin, a bent portion of the end of the hinge pin 40, or any other feature that will hold the hinge pin 40 in place. Such an arrangement may enable the head 41 of the hinge pin 40 to engage an adjacent, outermost hinge member (e.g., hinge member 26*a* in the embodiment illustrated by FIG. 1) and the fastener 42 to engage an adjacent, outermost hinge member (e.g., hinge member 36*b* in the embodiment illustrated by FIG. 1).

The clip 10 may include a hinge spring 45. The hinge spring 45 may be associated with the hinge pin 40. For example, the hinge spring 45 may comprise a coiled compression spring positioned around the hinge pin 40 and located between the head 41 of the hinge pin 40 and the hinge member adjacent to the head 41 of the hinge pin 40 (e.g., hinge member 26*a* in the embodiment illustrated by FIG. 1). Thus, the hinge spring 45 may force the hinge pin 40 in a direction that causes the fastener 42 of the hinge pin 40 to engage the adjacent hinge member (e.g., hinge member 36*b* in the embodiment illustrated by FIG. 1) and to pull that hinge member and the remainder of the side of clip 10 (e.g., the second side 30 in the embodiment illustrated by FIG. 1) in the same direction the head 41 is forced. As the side of the clip 10 moves, each corresponding pair of engagement features 27*a* and 37*a*, 27*b* and 37*b*. As the corresponding engagement features 27*a* and 37*a*, 27*b* and 37*b* engage one another, the positions of the first side 20 and the second side 30 of the clip 10 may be at least partially locked into position relative to one another (e.g., prevented from opening further relative to each other). Additionally, the engagement of the corresponding engagement features 27*a* and 37*a*, 27*b* and 37*b* may enable the first side 20 and the second side 30 to be moved closer to one another in a manner that locks the positions of the first side 20 and the second side 30 in progressively closer arrangements.

The hinge members 26*a*, 26*b*, 36*a*, 36*b*, their respective engagement features 27*a*, 27*b*, 37*a*, 37*b*, the hinge pin 40, and the hinge spring 45 comprise a lock 60 of the clip 10. In addition, the lock 60 may comprise tabs 62 and 63 that protrude from the top portions 21 and 31 of the first side 20 and second side 30, respectively, of the clip 10. The tabs 62 and 63 may be oriented generally parallel to one another and positioned such that, when they are forced together (e.g., while being pressed together by an individual's thumb and index finger, etc.), overcome the force of the hinge spring 45 to cause corresponding pairs of engagement features 27*a* and 37*a*, 27*b* and 37*b* to disengage each other, releasing the lock 60, enabling the first side 20 and the second side 30 of the clip 10 to move away from one another and, thus, enabling opening of the clip 10.

Another spring 50 may also reside on the hinge pin 40. That spring 50 may have a configuration that forces the first side 20 and the second side 30 of the clip 10 to pivot away from each other, into their open arrangement. The spring 50 may comprise a helical torsion spring with legs 52 and 53 that are oriented transverse to (e.g., substantially perpendicular to, etc.) a length of the coiled portion 51 of the spring 50. The legs 52 and 53 may extend in somewhat opposite directions from one another. A first leg 52 may extend over an interior surface of the upper top 21 of the first side 20 of the clip 10, while a second leg 53 may extend over an interior surface of the upper top 31 of the second side 30 of the clip 10. As the first side 20 and the second side 30 move pivotally towards each other, the spring 50 stores energy, which is exerted against the first side 20 and the second side 30 of the clip. While the lock 60 is engaged, the spring 50 stores the torque. When the lock 60 is released, the torque is released from the spring 50 in a manner that causes the first side 20 and the second side 30 of the clip 10 to pivot away from each other.

A clip 10 according to this disclosure may also include a first handle 29 associated with the first side 20 and a second handle 39 associated with the second side 30. The first handle 29 and the second handle 39 may be oriented to move the tines 22 that define the first grasping portion of the first side 20 and the tines 32 that define the second grasping portion of the second side 30 apart from each other as the first handle 29 and the second handle 39 are pushed (e.g., squeezed, etc.) together.

In use, the tabs 62 and 63 of a clip 10, which may be positioned adjacent to opposite ends of a hinge pin 40 of the clip 10, may be pressed together (e.g., between an index finger and a thumb on the same hand, etc.) to overcome the force of the hinge spring 45, thereby enabling the corresponding engagement features 27*a* and 37*a*, 27*b* and 37*b* to disengage one another and releasing the lock 60 of the clip 10. With the lock 60 released, the spring 50 of the clip 10 may force the first side 20 and the second side 30 of the clip 10 to pivot apart from one another into an open arrangement. With the first side 20 and the second side 30 and, thus, the clip 10 in the open arrangement, the tabs 62 and 63 may be released, enabling the hinge spring 45 on the hinge pin 40 to move, or force, the hinge pin 40 in a direction that will cause corresponding engagement features 27*a* and 37*a*, 27*b* and 37*b* to engage each other.

While the clip 10 is in the open arrangement, it may be positioned over an object that is to be grasped, such as a tuft of hair. Once the clip 10 has been positioned as desired, the first side 20 and the second side 30 of the clip 10 may then be pressed, or forced, together until they grasp, or engage, the object. As the first side 20 and the second side 30 pivot toward one another, the corresponding engagement features 27*a* and 37*a*, 27*b* and 37*b* progressively (e.g., continuously, incrementally, etc.) fix corresponding hinge members 26*a* and 36*a*, 26*b* and 36*b* into increasingly closed rotational positions that prevent the corresponding hinge members 26*a* and 36*a*, 26*b* and 36*b* from rotating in the opposite direction, into more open positions as long as the corresponding engagement features 27*a* and 37*a*, 27*b* and 37*b* remain engaged.

When removal of the clip 10 from the object is desired, the tabs 62 and 63 may again be pressed together to release the lock 60 and to enable the spring 50 to move the first side 20 and the second side 30 into their open arrangement. With the clip 10 in the open arrangement, it may then be pulled away from the object.

Although this disclosure provides many specifics, the specifics should not be construed as limiting the scope of any appended claim, but merely as providing information pertinent to some specific embodiments that may fall within the scopes of the appended claims. Features from different embodiments may be employed in combination. In addition, the scope of each appended claim may encompass other, undisclosed embodiments. All additions to, deletions from, and modifications of the disclosed subject matter that fall within the scopes of the claims are to be embraced by the claims.

What is claimed:

1. A clip, comprising:

a first side including:

a first hinge portion with a first engagement feature; and a first grasping portion including a plurality of first tines with first ends that face a first direction and;

a second side including:

a second hinge portion with a second engagement feature that can interact with the first engagement feature of the first hinge portion of the first side; and a second grasping portion including a plurality of second tines with second ends that face a second direction, the second direction opposing the first direction;

a hinge pin that:

is longitudinally slidable relative to the first side;

slidably extends through the first hinge portion of the first side;

is fixed to the second hinge portion such that the second hinge portion and the second side move longitudinally with the hinge pin; and enables the first side to pivot relative to the second side; and a hinge spring that resiliently forces the hinge pin in a longitudinal direction that forces the second hinge portion toward the first hinge portion and enables the second engagement feature to engage the first engagement feature.

2. The clip of claim 1, wherein the first engagement feature and the second engagement feature comprise complementary ratcheting features.

3. The clip of claim 2, wherein the complementary ratcheting features comprises complementary ratcheting teeth.

4. The clip of claim 2, wherein the complementary ratcheting features enable the first side to move toward the second side while preventing the first side from moving away from the second side.

5. The clip of claim 1, wherein:

the first hinge portion of the first side includes at least two first members that are spaced apart from each other;

the second hinge portion of the second side includes at least two second members that are spaced apart from each other;

the hinge pin:

extends through apertures through the at least two first members of the first hinge portion without engaging the at least two first members; and being fixed to at least one second member of the at least two second members of the second hinge portion such that the at least two second members and the second side move longitudinally with the hinge pin.

6. The clip of claim 5, wherein:

each member of the at least two first members of the first hinge portion of the first side includes a first engagement feature; and each member of the at least two second members of the second hinge portion of the second side includes a second engagement feature.

7. The clip of claim 5, wherein:

the hinge pin includes a helical thread;

the hinge pin extends through a helically threaded aperture of at least one member of the at least two second members of the second hinge portion of the second side; and the helical thread of the hinge pin engages the helically threaded aperture of the at least one member of the at least two second members of the second hinge portion.

8. The clip of claim 5, wherein:

longitudinal movement of the hinge pin in a first direction pushes the at least two first members of the second hinge portion away from their respective at least two second members of the second hinge portion.

9. The clip of claim 8, wherein:

the hinge spring forces the at least two first members of the second hinge portion toward their respective at least two second members of the first hinge portion.

10. The clip of claim 1, wherein the hinge spring is located between a head of the hinge pin and the first hinge portion of the first side.

11. The clip of claim 1, wherein the plurality of first tines of the first grasping member of the first side and the plurality of second tines of the second grasping member of the second side become interleaved with each other as the first side moves toward the second side.

12. The clip of claim 1, wherein the plurality of first tines of the first grasping member of the first side and the plurality of second tines of the second grasping member of the second side have configurations that enable them to grasp an individual's hair.

13. The clip of claim 12, wherein the clip is in the form of a claw clip for hair.

14. The clip of claim 13, wherein the clip is in the form of an octopus type clip for hair.

* * * * *